US011137706B2

(12) United States Patent
Takagi

(10) Patent No.: US 11,137,706 B2
(45) Date of Patent: Oct. 5, 2021

(54) HEATER AND FIXING APPARATUS

(71) Applicant: TOSHIBA TEC KABUSHIKI KAISHA, Tokyo (JP)

(72) Inventor: Osamu Takagi, Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/814,318

(22) Filed: Mar. 10, 2020

(65) Prior Publication Data

US 2020/0249607 A1 Aug. 6, 2020

Related U.S. Application Data

(63) Continuation of application No. 15/621,630, filed on Jun. 13, 2017, now abandoned.

(30) Foreign Application Priority Data

Jun. 20, 2016 (JP) ..... 2016-121437
Mar. 24, 2017 (JP) ..... 2017-059887

(51) Int. Cl.
*G03G 15/20* (2006.01)

(52) U.S. Cl.
CPC ..... *G03G 15/2057* (2013.01); *G03G 15/2021* (2013.01); *G03G 15/2042* (2013.01); *G03G 15/2053* (2013.01); *G03G 2215/2025* (2013.01)

(58) Field of Classification Search
CPC ..... G03G 15/2053; G03G 2215/2025
USPC ..... 219/216
See application file for complete search history.

(56) References Cited

U.S. PATENT DOCUMENTS

| | | | |
|---|---|---|---|
| 5,171,969 | A | 12/1992 | Nishimura et al. |
| 9,261,832 | B2 | 2/2016 | Muramatsu et al. |
| 10,416,598 | B2 | 9/2019 | Shimura et al. |
| 2004/0070660 | A1 | 4/2004 | Mochizuki et al. |
| 2011/0052279 | A1 | 3/2011 | Kagawa |
| 2011/0091251 | A1 | 4/2011 | Kim et al. |
| 2014/0314459 | A1 | 10/2014 | Samei |
| 2015/0037052 | A1 | 2/2015 | Muramatsu et al. |
| 2017/0102650 | A1 | 4/2017 | Shimura et al. |
| 2019/0377289 | A1 | 12/2019 | Shimura et al. |

FOREIGN PATENT DOCUMENTS

| | | | |
|---|---|---|---|
| JP | 2002-214951 | A | 7/2002 |
| JP | 2015-28531 | A | 2/2015 |
| JP | 2629980 | | 2/2015 |
| JP | 2015194713 | A | 11/2015 |
| WO | 2015/141217 | A1 | 9/2015 |

OTHER PUBLICATIONS

Extended European Search Report dated Nov. 3, 2017, filed in counterpart European Patent Application No. 17176301.4 (9 pages).
English Translation of Japanese Office Action dated Jan. 26, 2021 in corresponding Japanese Patent Application 2017-059887, 4 pages.

*Primary Examiner* — Arlene Heredia
(74) *Attorney, Agent, or Firm* — Kim & Stewart LLP

(57) ABSTRACT

A heater includes an insulator substrate, a heat generating section in which a plurality of divided regions are formed in a longitudinal direction on a first surface of the insulator substrate, electrodes formed at both end portions of the heat generating section to correspond to the plurality of divided regions, and electric conductors connected to at least one of the electrodes and formed over a surface different from the first surface of the insulator substrate.

14 Claims, 10 Drawing Sheets

HEATER AND FIXING APPARATUS

CROSS-REFERENCE TO RELATED APPLICATION

This application is a continuation of U.S. patent application Ser. No. 15/621,630, filed on Jun. 13, 2017, which application is based upon and claims the benefit of priority from the prior Japanese Patent Application No. 2016-121437, filed on Jun. 20, 2016, and Japanese Patent Application No. 2017-059887, filed on Mar. 24, 2017, the entire contents all of which are incorporated herein by reference.

FIELD

Embodiments described herein relate generally to a heater and a fixing apparatus.

BACKGROUND

In a fixing apparatus mounted on an image forming apparatus, since the temperature of a portion where a recording medium does not pass excessively rises, it is undesirable from the viewpoint of energy saving to heat the portion where the recording medium does not pass. Therefore, there is known a technique for intensively heating only a passing region of the recording medium or an image forming region in the recording medium (JP-A-2015-28531).

However, in order to group juxtaposed respective heat generating sections and feed AC power to the heat generating sections, it is necessary to provide individual power feeding paths having a large current capacity on the same substrate according to the grouped heat generating sections.

For example, if the groups are five groups, five power feeding paths are necessary. It is necessary to juxtapose the individual power feeding paths on a substrate on which the heat generating sections are provided.

Moreover, the power feeding paths need to be provided to be separated from one another at a reasonable distance because a certain degree of an electric current needs to be fed through the power feeding paths. Besides regions of the heat generating sections originally necessary to heat the recording medium, regions for wiring have to be secured on a substrate surface opposed to the recording medium.

DETAILED DESCRIPTION

An object of embodiments is to provide a heater and a fixing apparatus in which a substrate surface opposed to a recording medium can be reduced irrespective of divided regions of a heat generating body and an output of the heat generating body.

In general, according to one embodiment, a heater includes: an insulator substrate; a heat generating section in which a plurality of divided regions are formed in a longitudinal direction on a first surface of the insulator substrate; electrodes formed at both end portions of the heat generating section to correspond to the plurality of divided regions; and electric conductors connected to at least one of the electrodes and formed over a surface different from the first surface of the insulator substrate.

First Embodiment

Figure 1:
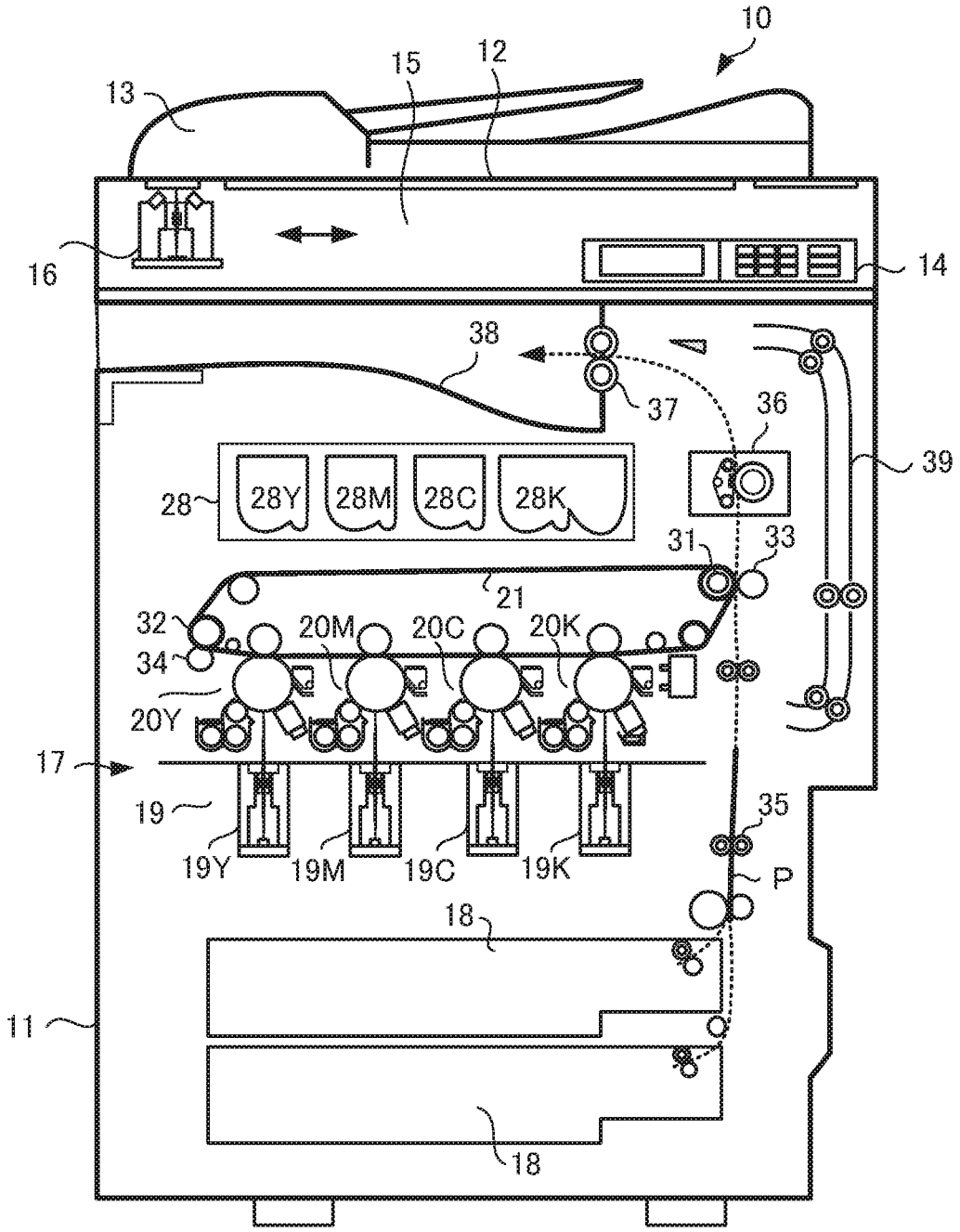
FIG. 1 is a diagram showing a configuration example of an image forming apparatus including a fixing apparatus according to a first embodiment.

FIG. 1 is a diagram showing a configuration example of an image forming apparatus including a fixing apparatus according to a first embodiment. In FIG. 1, the image forming apparatus is, for example, an MFP (Multi-Function Peripherals), which is a compound machine, a printer, or a copying machine. In the following explanation, an MFP 10 is explained as an example.

A document table 12 of transparent glass is present in an upper part of a main body 11 of the MFP 10. An automatic document feeder (ADF) 13 is provided on the document table 12 to be capable of opening and closing. An operation panel 14 is provided in an upper part of the main body 11. The operation panel 14 includes various keys and a display unit of a touch panel type.

A scanner unit 15, which is a reading device, is provided below the ADF 13 in the main body 11. The scanner unit 15 reads an original document fed by the ADF 13 or an original document placed on the document table and generates image data. The scanner unit 15 includes an image sensor 16 of a contact type. The image sensor 16 is disposed in a main scanning direction (a direction orthogonal to a conveying direction of the original document fed by the ADF 13; in FIG. 1, the depth direction).

When the image sensor 16 reads an image of the original document placed on the document table 12, the image sensor 16 reads a document image line by line while moving along the document table 12. The image sensor 16 executes the reading over the entire document size to perform reading of the original document for one page. When the image sensor 16 reads an image of the original document fed by the ADF 13, the image sensor 16 is present in a fixed position (a position shown in the figure).

Further, the MFP 10 includes a printer unit 17 in the center in the main body 11. The MFP 10 includes, in a lower part of the main body 11, a plurality of paper feeding cassettes 18 that store sheets P (recording media) of various sizes. The printer unit 17 includes, as exposing devices, photoconductive drums and a scanning head 19 including LEDs. The printer unit 17 scans the photoconductive drums with rays from the scanning head 19 and generates images.

The printer unit 17 processes image data read by the scanner unit 15 or image data created by a personal computer or the like to form an image on a sheet. The printer unit 17 is, for example, a color laser printer by a tandem type. The printer unit 17 includes image forming units 20Y, 20M, 20C, and 20K of respective colors of yellow (Y), magenta (M), cyan (C), and black (K). The image forming units 20Y, 20M, 20C, and 20K are disposed in parallel from an upstream side to a downstream side on a lower side of an intermediate transfer belt 21. The scanning head 19 includes a plurality of scanning heads 19Y, 19M, 19C, and 19K corresponding to the image forming units 20Y, 20M, 20C, and 20K.

Figure 2:
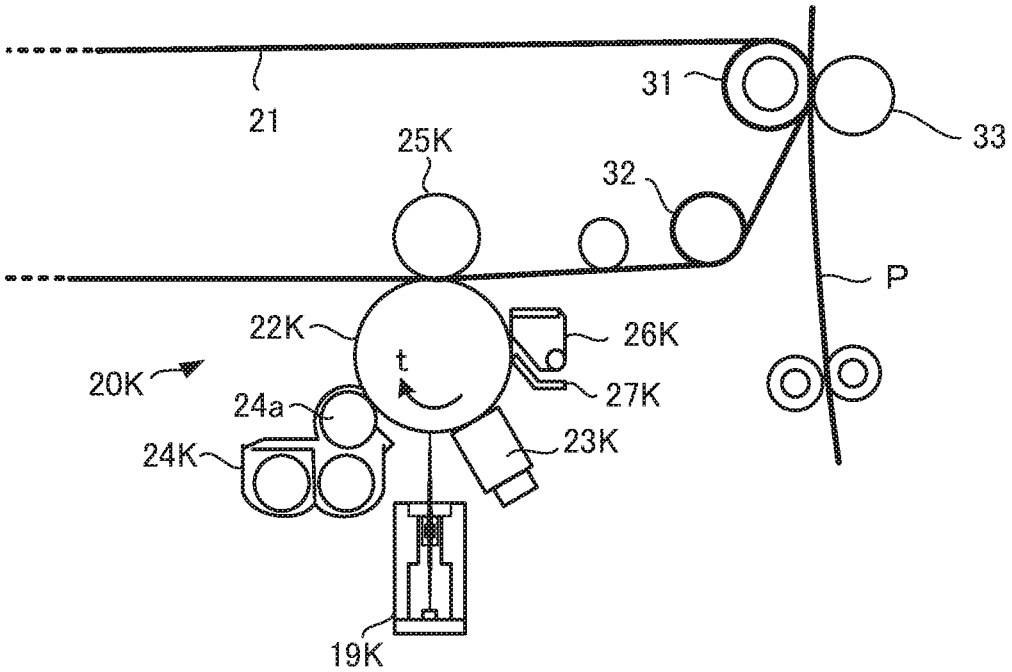
FIG. 2 is an enlarged configuration diagram showing a part of an image forming unit in the first embodiment.

FIG. 2 is an enlarged diagram of the image forming unit 20K among the image forming units 20Y, 20M, 20C, and 20K. Note that, in the following explanation, the image forming units 20Y, 20M, 20C, and 20K have the same configuration. Therefore, the image forming unit 20K is explained as an example.

The image forming unit 20K includes a photoconductive drum 22K, which is an image bearing body. A charging device 23K, a developing device 24K, a primary transfer roller (a transfer device) 25K, a cleaner 26K, a blade 27K, and the like are disposed along a rotating direction t around the photoconductive drum 22K. Light is irradiated on an exposure position of the photoconductive drum 22K from the scanning head 19K to form an electrostatic latent image on the photoconductive drum 22K.

The charging device 23K of the image forming unit 20K uniformly charges the surface of the photoconductive drum 22K. The developing device 24K supplies, with a developing roller 24*a* to which a developing bias is applied, a two-component developer including a black toner and a carrier to the photoconductive drum 22K and performs development of the electrostatic latent image. The cleaner 26K removes a residual toner on the surface of the photoconductive drum 22K using the blade 27K.

As shown in FIG. 1 a toner cartridge 28 that supplies toners to developing devices 24Y, 24M, 24C, and 24K is provided above the image forming units 20Y, 20M, 20C, and 20K. The toner cartridge 28 includes toner cartridges 28Y, 28M, 28C, and 28K of the colors of yellow (Y), magenta (M), cyan (C), and black (K).

The intermediate transfer belt 21 moves in a cyclical manner. The intermediate transfer belt 21 is stretched and suspended by a driving roller 31 and a driven roller 32. The intermediate transfer belt 21 is opposed to and in contact with the photoconductive drums 22Y, 22M, 22C, and 22K. A primary transfer voltage is applied to a position of the intermediate transfer belt 21 opposed to the photoconductive drum 22K by the primary transfer roller 25K. A toner image on the photoconductive drum 22 is primarily transferred onto the intermediate transfer belt 21.

A secondary transfer roller 33 is disposed to be opposed to the driving roller 31 that stretches and suspends the intermediate transfer belt 21. When a sheet P passes between the driving roller 31 and the secondary transfer roller 33, a secondary transfer voltage is applied to the sheet P by the secondary transfer roller 33. The toner image on the intermediate transfer belt 21 is secondarily transferred onto the sheet P. A belt cleaner 34 is provided near the driven roller 32 in the intermediate transfer belt 21.

As shown in FIG. 1, paper feeding rollers 35 that convey the sheet P extracted from the paper feeding cassettes 18 are provided between the paper feeding cassettes 18 and the secondary transfer roller 33. Further, a fixing apparatus 36 is provided downstream of the secondary transfer roller 33. A conveying roller 37 is provided downstream of the fixing apparatus 36. The conveying roller 37 discharges the sheet P to a paper discharge section 38. Further, a reversal conveying path 39 is provided downstream of the fixing apparatus 36. The reversal conveying path 39 reverses the sheet P and guides the sheet P in the direction of the secondary transfer roller 33. The reversal conveying path 39 is used when duplex printing is performed.

FIGS. 1 and 2 show an example of the embodiment and do not limit the structures of image forming apparatus portions other than the fixing apparatus 36. The structure of a publicly-known electrophotographic image forming apparatus can be used.

Figure 3:
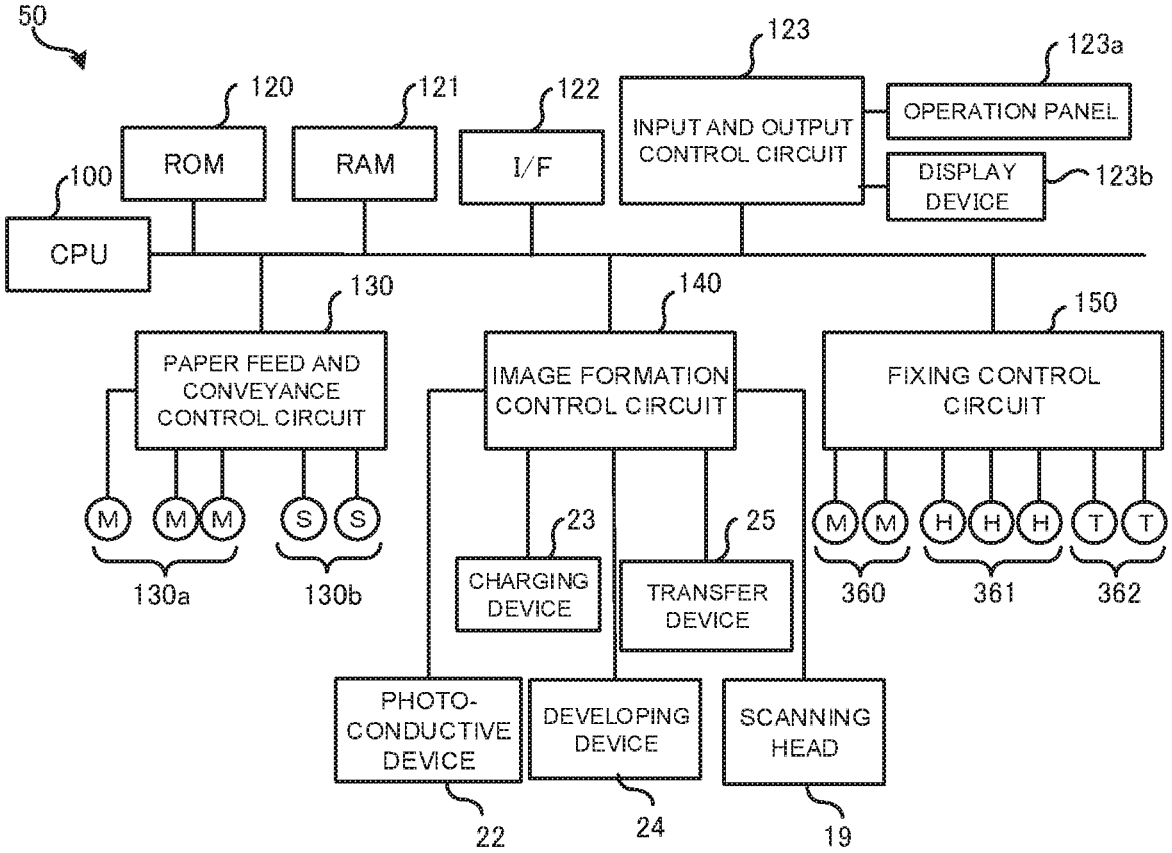
FIG. 3 is a block diagram showing a configuration example of a control system of an MFP in the first embodiment.

FIG. 3 is a block diagram showing a configuration example of a control system 50 of the MFP 10 in the embodiment. The control system 50 includes, for example, a CPU 100 that controls the entire MFP 10, a read only memory (ROM) 120, a random access memory (RAM) 121, an interface (I/F) 122, an input and output control circuit 123, a paper feed and conveyance control circuit 130, an image formation control circuit 140, and a fixing control circuit 150.

The CPU 100 realizes a processing function for image formation by executing a computer program stored in the ROM 120 or the RAM 121. The ROM 120 stores a control program, control data, and the like for controlling a basic operation of image formation processing. The RAM 121 is a working memory. The ROM 120 (or the RAM 121) stores, for example, control programs for the image forming unit 20, the fixing apparatus 36, and the like and various control data used by the control programs.

Specific examples of the control data in this embodiment include a correspondence relation between the size (the width in the main scanning direction) of a printing region in a sheet and a heat generating section set as a power feed target.

A fixing temperature control program of the fixing apparatus 36 includes a determination logic for determining the size of an image forming region in a sheet on which a toner image is formed and a heating control logic for selecting a switching element of a heat generating section corresponding to a position where the image forming region passes and feeding electric power to the switching element before the sheet is conveyed into the inside of the fixing apparatus 36 and controlling heating in a heating unit.

The I/F 122 performs communication with various apparatuses such as a user terminal and a facsimile. The input and output control circuit 123 controls an operation panel 123*a* and a display device 123*b*. The paper feed and conveyance control circuit 130 controls a motor group 130*a* and the like that drive the paper feeding rollers 35, the conveying roller 37 in a conveying path, or the like.

The paper feed and conveyance control circuit 130 controls the motor group 130*a* and the like on the basis of control signals from the CPU 100 taking into account detection results of various sensors 130*b* near the paper feeding cassettes 18 or on the conveying path. The image formation control circuit 140 controls the photoconductive drum 22, the charging device 23, the scanning head 19, the developing device 24, and the transfer device 25 respectively on the basis of control signals from the CPU 100.

The fixing control circuit 150 controls a driving motor 360, a heating member 361, and a temperature detecting unit 362 such as a thermistor of the fixing apparatus 36 respectively on the basis of control signals from the CPU 100.

Note that, in this embodiment, the control program and the control data of the fixing apparatus 36 are stored in a storage device of the MFP 10 and executed by the CPU 100. However, an arithmetic operation device and a storage device may be separately provided exclusively for the fixing apparatus 36.

Figure 4:
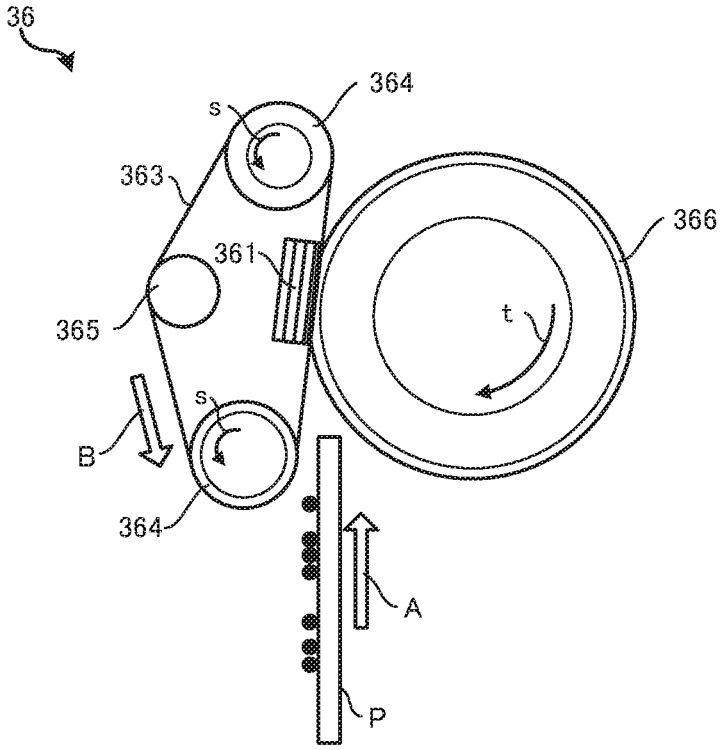
FIG. 4 is a diagram showing a configuration example of the fixing apparatus according to the first embodiment.

FIG. 4 is a diagram showing a configuration example of the fixing apparatus 36. The fixing apparatus 36 includes the tabular heating member 361, an endless rotating body, for example, an endless belt 363 on which an elastic layer is formed and that is suspended by a plurality of rollers, a belt conveying roller 364 that drives the endless belt 363, a tension roller 365 that applies tension to the endless belt 363, and a press roller 366, on the surface of which an elastic layer is formed.

In the heating member 361, a heat generating section 361A including a heat generating body 361*a*, a heat generating body 361*b*, and a heat generating body 361*c* functioning as a plurality of divided regions is disposed in contact with the inner side of the endless belt 363. The heating member 361 is pressed in the press roller 366 direction to form a fixing nip having a predetermined width between the heating member 361 and the press roller 366. With this configuration, the heating member 361 performs heating while forming a nip region. Therefore, responsiveness during power feed is higher than responsiveness of a heating type by a halogen lamp. Note that, in the embodiment explained above, the heat generating section 361A is disposed in contact with the inner side of the endless belt 363. However, it is not always necessary to set the heat generating section 361A and the endless belt 363 in contact with each other. Some member may be interposed between the heat generating section 361A and the endless belt 363.

In the endless belt 363, a silicon rubber layer having thickness of 200 μm is formed, for example, on the outer side on a SUS base material having thickness of 50 μm or polyimide, which is heat resistant resin having thickness of 70 μm. The outermost circumferential surface of the endless belt 363 is covered by a belt protecting layer of PFA or the like. In the press roller 366, for example, a silicon sponge layer having thickness of 5 mm is formed on the surface of an iron bar of ϕ10 mm. The outermost circumference of the press roller 366 is covered by a belt protecting layer of PFA or the like.

In the heating member 361, for example, a heat generation resistance layer or a glaze layer and the heat generation resistance layer are stacked on an insulator such as a ceramic substrate. The glaze layer does not have to be present. The heat generation resistance layer is formed of a known material such as TaN or $TaSiO_2$ and is divided into a predetermined length and a predetermined number of pieces in the main scanning direction. Details of the division are explained below.

Figure 5:
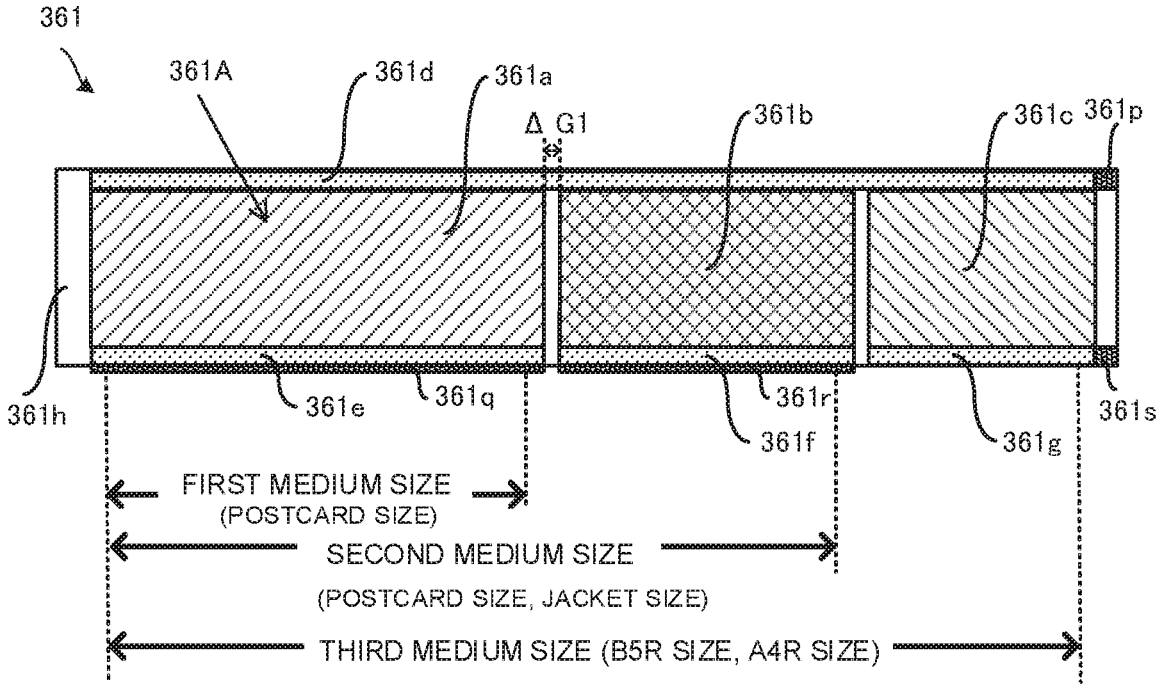
FIG. 5 is a top view showing the disposition and a power feeding structure of a heat generating section in the first embodiment.

FIG. 5 is a top view showing the disposition and a power feeding structure of the heat generating section in this embodiment. A heat generating region of the heating member 361 is divided into heat generating sections having three kinds of length to correspond to a postcard size (100×148 mm), a CD jacket size (121×121 mm), a B5R size (182×257 mm), and an A4R size (210×297 mm). The heat generating sections are formed to have a margin of approximately 5% in a heating region taking into account conveyance accuracy and a skew of a conveyed sheet and release of heat to a non-heated portion.

In an example shown in FIG. 5, the heat generating body 361*a* is provided on the leftmost side in the main scanning direction (the longitudinal direction) to cope with the width 100 mm of the postcard size, which is a minimum size (a first medium size). The width of the heat generating body 361*a* is set to 105 mm. The heat generating body 361*b* having width of 50 mm is provided on the right side of the heat generating body 361*a* to cope with a size larger than the minimum size (a second medium size) 121 mm and 148 mm. Width up to 155 mm is covered by 148 mm+5%.

The heat generating body 361*c* having width 65 mm of the heat generating sections is provided further on the right side of the heat generating body 361*b* to cope with a larger size (a third medium size) 182 mm and 210 mm. Width up to 220 mm is covered by 210 mm+5%.

As shown in FIG. 5, all of one end portions of the heat generating body 361*a*, the heat generating body 361*b*, and the heat generating body 361*c* are connected to a common electrode 361*d*. However, the other end portions are respectively connected to electrodes 361*e* to 361*g*. The three divided heat generating bodies 361*a* to 361*c* and the electrodes 361*d* to 361*g* are fixed to the front surface (a first surface) of an insulator substrate 361*h* by the method explained above. Electrodes adjacent to each other of the divided electrodes 361*e* to 361*g* are separated from each other by a predetermined width ΔG1 or more in order to prevent a leak.

The common electrode 361*d* is connected to an electric conductor 361*p* among the heat generating bodies 361*a* to 361*c*. Similarly, the electrodes 361*e* to 361*g* are respectively connected to electric conductors 361*q* to 361*s*. All of the electric conductors 361*p* to 361*s* are connected to a power feeding device. Details of the electric conductors 361*q* to 361*s* are explained below.

Note that the number of divisions of the heat generating region and the widths of the divided heat generating regions are explained as an example and are not limited to the above. If the MFP 10 is adapted to, for example, five medium sizes, the heat generating region may be divided into five according to the medium sizes.

That is, it is possible to freely select the number of divisions and divided widths according to medium sizes corresponding thereto and cause a further segmented heat generating section group to uniformly generate heat. Similarly, it is also possible to select the heat generating bodies 361*a* to 361*c* of power feeding targets on the basis of a printing size (the size of the image forming region) instead of the medium sizes.

Note that it is also possible to configure the heat generating sections from a plurality of rectangular heat generating elements without continuously configuring the heat generating sections. That is, it is also possible to configure separated rectangular heat generating elements to be connected in parallel among individual electrodes opposed to the common electrode in the up-down direction in FIG. 5.

In the example shown in FIG. 5, the common electrode 361*d* and the electrodes 361*e*, 361*f*, and 361*g* are provided at both end portions in a latitudinal direction (the conveying direction of the sheet P) of the insulator substrate 361*h*. However, the embodiment is not limited to this. That is, an embodiment may be adopted in which a common electrode and individual electrodes are disposed at any one end portion or both end portions in the longitudinal direction (the direction orthogonal to the conveying direction of the sheet P) of the insulator substrate 361*h*.

In the example shown in FIG. 5, an example is shown in which a sheet is left-aligned, that is, an example of an asymmetrical configuration in which the heat generating sections are disposed mainly on the left side. However, in the embodiment, the heat generating sections can also be configured to be symmetrically disposed such that the center of the sheet is always present in the center irrespective of the width of the sheet. In the case of this configuration, if the sheet passes a center region in the main scanning direction (the left-right direction shown in the figure), the number of divisions, the sizes, and the positions of the heat generating sections only have to be changed as appropriate.

In this embodiment, a line sensor (not shown in the figure) is disposed in a paper passing region. The size and the position of a passing sheet can be determined on a real-time basis. A medium size may be determined from image data or information concerning the paper feeding cassettes 18, in which media (sheets) are stored in the MFP 10, during a start of a printing operation.

Figure 6:
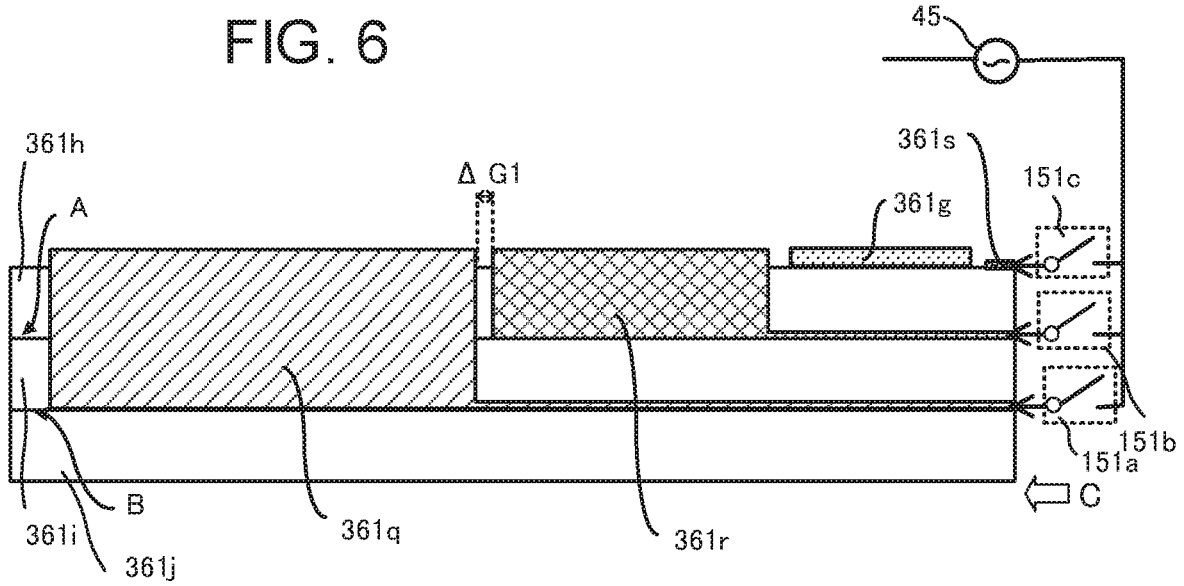
FIG. 6 is a side view showing the power feeding structure shown in FIG. 5.
Figure 7:
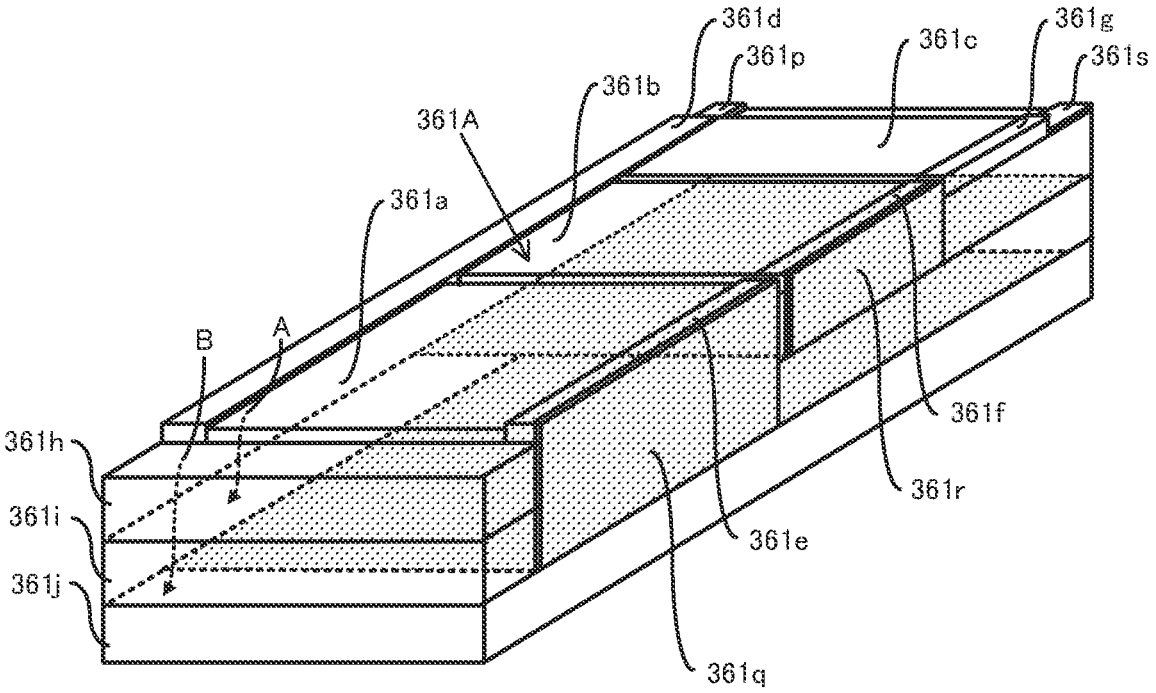
FIG. 7 is a transparent perspective view showing the power feeding structure shown in FIG. 5.

FIG. 6 is a side view showing the power feeding structure shown in FIG. 5. FIG. 7 is a transparent perspective view showing the power feeding structure. As shown in the figures, the heating member 361 includes a plurality of insulator substrates 361*h* to 361*j* disposed in a stacked state. A plurality of heat generating sections are fixed to a top layer of the plurality of insulator substrates 361*h* to 361*j*. The insulator substrates 361*h* to 361*j* are provided on the basis of the number of heat generating sections. In the figures, since a heat generating region is divided into three, the power feeding structure is a three-layer structure. However, the number of divided heat generating regions and the number of layers are not always the same.

The number of stacked layers of a substrate is set to a number necessary to secure formation regions of power feeding patterns corresponding to the divided heat generating regions. If a current capacity is sufficient, the substrate may include one layer. In that case, for example, an electric conductor is formed over the rear surface (the opposite surface) of a first surface of this insulating layer.

If one insulating layer is insufficient in a relation with the current capacity, an electric conductor of one pattern may be used in a plurality of layers.

Note that the heating member 361 is not limited to the insulator substrates 361*h* to 361*j* made of ceramic. For example, a material having heat resistance and insulation functions such as a glaze layer containing glass as a main component may be applied in a plurality of layers by a printing method. In this case, in FIG. 6, a portion equivalent to the insulator substrate 361*j* is printed and formed by glaze or the like first, the electrode 361*e* is formed on the portion, a portion equivalent to the insulator substrate 361*i* is also printed and formed on the electrode 361*e* by glaze or the like, and the electrode 361*f* is formed on the portion. The insulator substrates 361*h* and 361*g* are formed in the same procedure.

Note that, when the heating member 361 is formed, an insulating layer (an insulator substrate) made of ceramic and an insulating layer by the printing method containing glaze or the like as a raw material may be mixed.

The electric conductor 361*q* is continuously formed over side surfaces of the insulator substrate 361*h* of a first layer and the insulator substrate 361*i* of a second layer and a boundary surface B between the insulator substrate 361*i* and the insulator substrate 361*j* of a third layer. Similarly, the electric conductor 361*r* is continuously formed over a side surface of the insulator substrate 361*h* and a boundary surface A between the insulator substrate 361*h* and the insulator substrate 361*i*.

As shown in FIG. 7, the electric conductor 361*q* and the electric conductor 361*r* form tabular good conductor layers on the side surface of the substrates and the boundary surface B and the boundary surface A. The thickness of the good conductor layers are suitably set to, for example, approximately 10 μm. Note that, in this embodiment, the electric conductor 361*q* and the electric conductor 361*r* are provided on the side surfaces of the insulator substrates. However, it is also possible to cause the electric conductors to conduct to a power feeding path from the electrode portions through through-holes formed inside the insulators without using the side surface.

In an example shown in FIGS. 6 and 7, a disposition space for the electric conductor 361*s* can be secured on the upper surface of the insulator substrate 361*h* of the first layer. Therefore, the electric conductor 361*s* is not formed on the boundary surface between the insulator substrates. However, if it is difficult to secure a disposition space for an electric conductor on a surface same as a heat generating surface because of design, it is also possible to increase the number of stacked layers of the insulator substrate as appropriate and continuously form the electric conductor over a side surface of a substrate and a boundary surface as in other cases. The same holds true concerning the electric conductor 361*p* disposed on the common electrode 361*d* side between the heat generating sections.

The electric conductors 361*p* to 361*r* are disposed to configure parallel power feeding paths between the plurality of electrodes 361*d* to 361*g* and the power feeding device such that the power feeding paths adjacent to one another are separated by the predetermined width ΔG or more.

Formation of the electric conductors 361*p* to 361*r*, which are good conductor layers, may be simultaneously performed during formation of the insulator substrates 361*h* to 361*j*. Alternatively, the electric conductors 361*p* to 361*r* may be stuck to the insulator substrates 361*h* to 361*j* later. Note that, in this embodiment, a good conductor layer is not provided on the bottom surface side of the lowermost layer (the third layer). This is suitable for disposing the temperature detecting unit 362.

A method of forming the heat generation resistance layer is the same as a known method, for example, a method of creating a thermal head. An aluminum layer (an electrode layer) is formed on the heat generation resistance layer by masking. The aluminum layer is formed in a pattern in which the adjacent heat generating regions are insulated and the heat generating sections (resistant heat generating bodies) are exposed in the sheet conveying direction. For power feed to the heat generating sections, the heat generating sections are connected by electric conductors (wires) from aluminum layers (electrodes) at both ends and are respectively connected to switching elements or the like of a switching driver.

Figure 18:
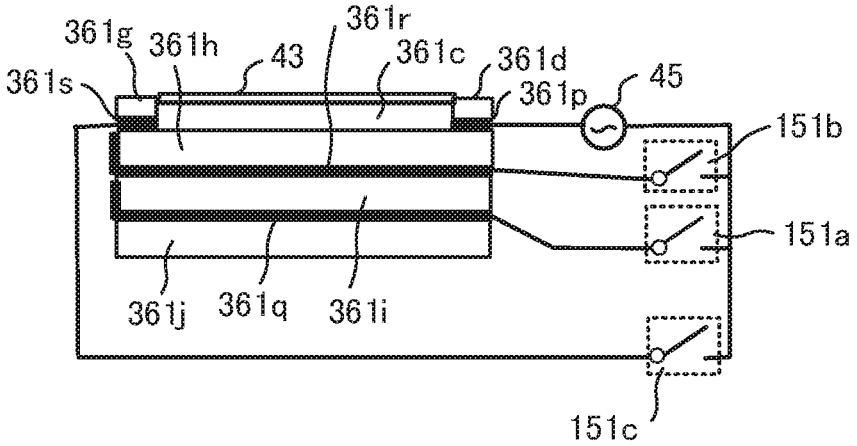
FIG. 18 is a diagram of the power feeding structure shown in FIG. 6 viewed from a side.

Further, a surface protecting layer is formed in a top section to cover the resistant heat generating bodies, the aluminum layers, the wires, and the like (a surface protecting layer 43 shown in FIG. 18). Specific examples of driving ICs, which are switching units of the heat generating bodies 361*a* to 361*c*, include a switching element, an FET, a triax, and a switching IC. In the figures, the driving ICs are shown as switches 151*a*, 151*b*, and 151*c*.

The surface protecting layer 43 is formed by, for example, an SiN layer or an Si—O—N layer. If an alternating current or a direct current is supplied to such a heat generating section group, electric power is fed to, in a zero cross, a portion where heat is generated by the triax or the FET. Flicker is also taken into account.

Figure 8:
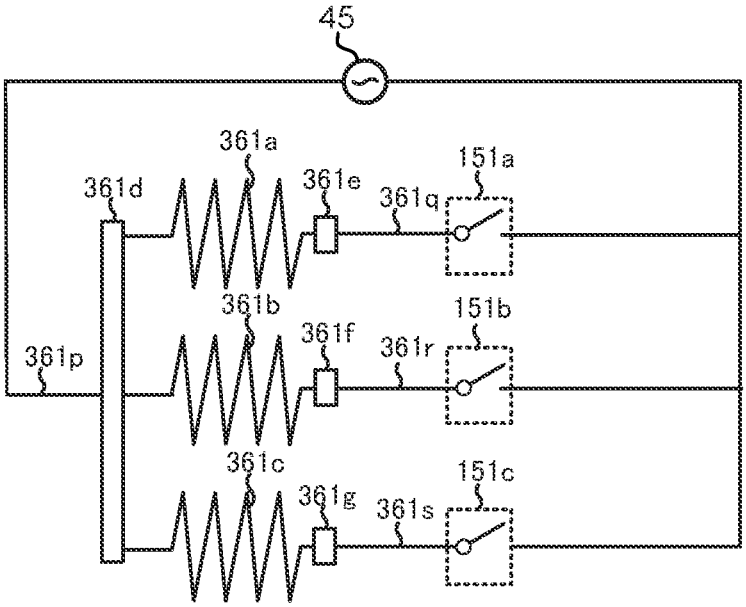
FIG. 8 is a circuit diagram corresponding to the power feeding structure shown in FIG. 5.

FIG. 8 is a circuit diagram showing the power feeding structure to the heat generating section group in the first embodiment. A parallel power feeding structure is shown in which energization of the heat generating bodies 361*a* to 361*c* is individually controlled by the switches 151*a* to 151*c* corresponding to the heat generating bodies 361*a* to 361*c*. The electric conductor 361*p* is connected to the common electrode 361*d* and connected to one end of an AC power supply 45. The other end of the AC power supply 45 is connected to one ends of the switches 151*a*, 151*b*, and 151*c* in common. The other ends of the switches are respectively connected to the electric conductors 361*q*, 361*r*, and 361*s*.

The electric conductors 361*q*, 361*r*, and 361*s* are respectively connected to the electrodes 361*e*, 361*f*, and 361*g*. The electrodes 361*e*, 361*f*, and 361*g* are respectively connected to one ends of the heat generating bodies 361*a*, 361*b*, and 361*c*. The other ends of the heat generating bodies 361*a*, 361*b*, and 361*c* are connected to the common electrode 361*d*.

If a circuit connection relation shown in FIG. 8 is shown in connection of a structure shown in FIG. 6, the circuit connection relation is as shown at the right end of FIG. 6. That is, the switch 151*a* is connected to the electric conductor 361*q*, the switch 151*b* is connected to the electric conductor 361*r*, and the switch 151*c* is connected to the electric conductor 361*s*. The switches 151*a*, 151*b*, and 151*c* are connected to the AC power supply 45 in common.

The configuration of the structure shown in FIG. 6 viewed from a side in a direction of an arrow C is shown in FIG. 18. That is, the insulator substrates 361*j*, 361*i*, and 361*h* are stacked, the electric conductor 361*q* is provided on the upper surface of the insulator substrate 361*j*, and the electric conductor 361*r* is provided on the upper surface of the insulator substrate 361*i*. Note that, in FIG. 18, the AC power supply 45 and the switches 151*a*, 151*b*, and 151*c* are shown as being disposed in the latitudinal direction of the insulator substrates 361*h*, 361*i*, and 361*j*. However, actually, the AC power supply 45 and the switches 151*a*, 151*b*, and 151*c* are disposed in the longitudinal direction.

One end of the AC power supply 45 is connected to the common electrode 361*d*. The other end of the AC power supply 45 is connected to the switches 151*a*, 151*b*, and 151*c*. The other end of the switch 151*c* is connected to the electric conductor 361*s*. The other end of the switch 151*a* is connected to the electric conductor 361*q* provided on a side surface of the insulator substrate 361*i* and the bottom surface of the substrate. The other end of the switch 151*b* is connected to the electric conductor 361*r* provided on a side surface of the insulator substrate 361*h* and the bottom surface of the substrate.

The surface protecting layer 43 explained above is provided on the upper surfaces of the heat generating body 361*c* and the heat generating bodies 361*a* and 361*b* not shown in FIG. 18.

As explained above, in the embodiment shown in FIG. 6, the components for connection from the electric conductors 361*q*, 361*r*, and 361*s* to the switches 151*a*, 151*b*, and 151*c* are integrated in the longitudinal direction of the insulator substrates 361*j*, 361*i*, and 361*h*. Therefore, there is an effect that laying of the wires is simplified.

Explanation of Operation During Printing in the First Embodiment

Figure 9:
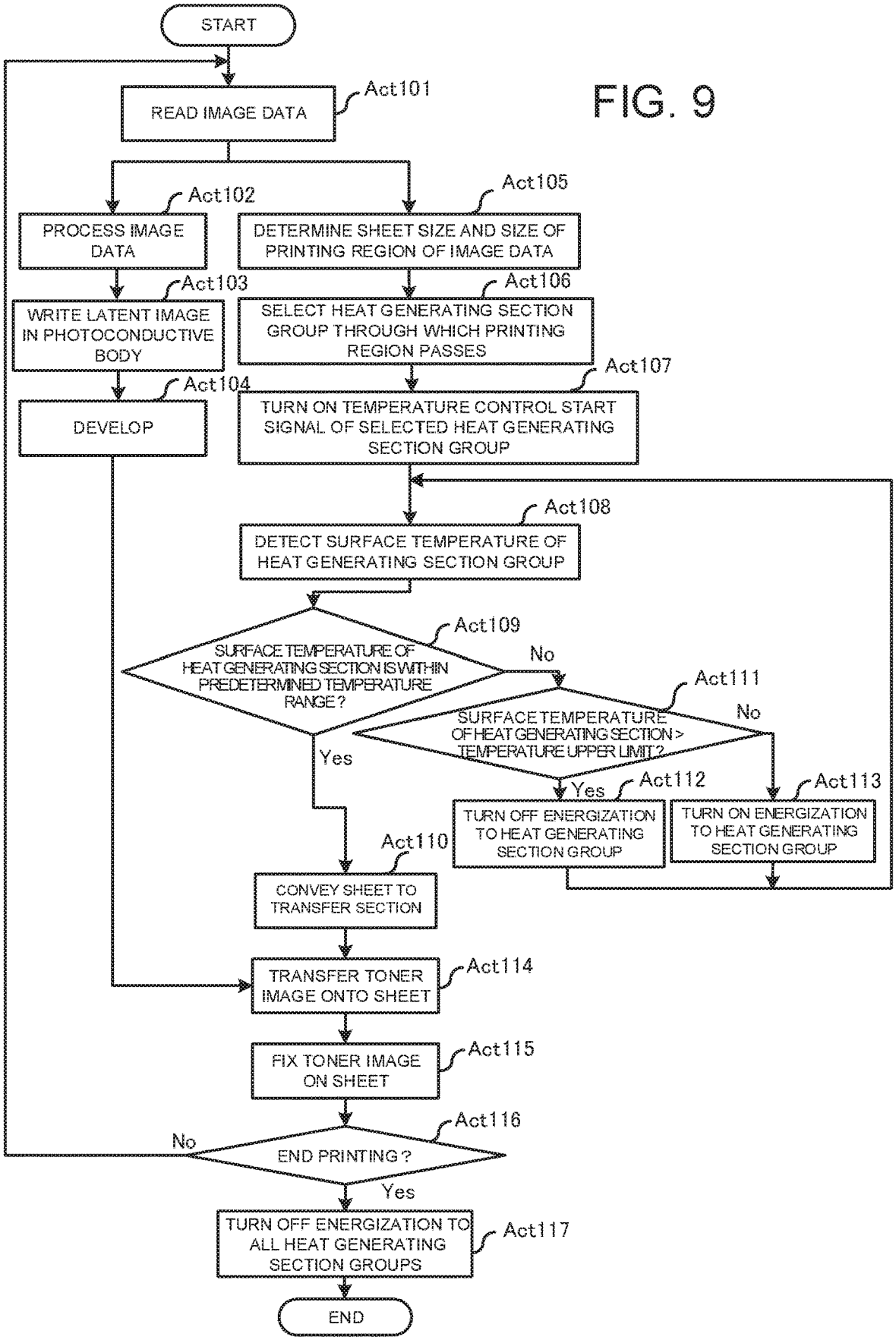
FIG. 9 is a flowchart showing a specific example of a control operation of the MFP in the first embodiment.

The operation during printing of the MFP 10 configured as explained above is explained below with reference to the drawings. FIG. 9 is a flowchart showing a specific example of control by the MFP 10 in the first embodiment.

First, the MFP 10 reads image data with the scanner unit 15 (Act 101). An image formation control program in the imaging forming unit 20 and a fixing temperature control program in the fixing apparatus 36 are executed in parallel.

If image formation processing is started, the MFP 10 processes the read image data (Act 102), writes an electrostatic latent image on the surface of the photoconductive drum 22 (Act 103), develops the electrostatic latent image with the developing device 24 (Act 104), and thereafter proceeds to Act 114.

On the other hand, if fixing temperature control processing is started, the MFP 10 determines a sheet size and the size of a printing range of the image data on the basis of, for example, a detection signal of a line sensor (not shown in the figure), sheet selection information by the operation panel 14, or an analysis result of the image data (Act 105) and selects, as a heat generation target, a heat generating section group disposed in positions where the printing range of the sheet P passes (Act 106).

Subsequently, if the MFP 10 turns on a temperature control start signal to the selected heat generating section group (Act 107), power feed to the selected heat generating section group is performed and temperature rises.

Subsequently, if the MFP 10 detects a surface temperature of the heat generating section group with the temperature detecting unit 362 disposed on the inner side or the outer side of the endless belt 363 (Act 108), the MFP 10 determines whether the surface temperature of the heat generating section group is within a predetermined temperature range (Act 109). If determining that the surface temperature of the heat generating section group is within the predetermined temperature range (Yes in Act 109), the MFP 10 proceeds to Act 110.

On the other hand, if determining that the surface temperature of the heat generating section group is not within the predetermined temperature range (No in Act 109), the MFP 10 proceeds to Act 111.

In Act 111, the MFP 10 determines whether the surface temperature of the heat generating section group exceeds a predetermined temperature upper limit value. If determining that the surface temperature of the heat generating section group exceeds the predetermined temperature upper limit value (Yes in Act 111), the MFP 10 turns off the power feed to the heat generating section group selected in Act 106 (Act 112) and returns to Act 108.

On the other hand, if determining that the surface temperature of the heat generating section group does not exceed the predetermined temperature upper limit value (No in Act 111), since the surface temperature is lower than a temperature lower limit value according to the determination result in Act 109, the MFP 10 maintains the power feed to the heat generating section group in the ON state or turns on the power feed again (Act 113) and returns to Act 108.

Subsequently, if the MFP 10 conveys the sheet P to a transfer section in a state in which the surface temperature of the heat generating section group is within the predetermined temperature range (Act 110), the MFP 10 transfers a toner image onto the sheet P (Act 114) and thereafter conveys the sheet P into the fixing apparatus 36.

Subsequently, if the MFP 10 fixes the toner image on the sheet P in the fixing apparatus 36 (Act 115), the MFP 10 determines whether to end the print processing of the image data (Act 116). If determining to end the print processing (Yes in Act 116), the MFP 10 turns off the power feed to all heat generating section groups (Act 117) and ends the processing.

On the other hand, if determining not to end the print processing of the image data yet (No in Act 116), that is, if printing target image data remains, the MFP 10 returns to Act 101 and repeats the same processing until the processing ends.

As explained above, according to this embodiment, the insulator substrates 361*h* to 361*j* are formed in the stacked structure. The divided electric conductor 361*q* is continuously formed over the side surfaces of the insulator substrate 361*h* and the insulator substrate 361*i* of the second layer and the boundary surface B between the substrates. The electric conductor 361*q* is continuously formed over the side surface of the insulator substrate 361*h* and the boundary surface B between the substrates. The electric conductor 361*s* is formed on the upper surface of the insulator substrate 361*h* of the first layer.

In this way, the good conductor layer is formed using not only the upper surface of the insulator substrate 361*h* of the first layer, which is the heat generating surface, but also the boundary surface between the insulator substrate and the side surface. Consequently, it is possible to reduce the number of power feeding paths (power feeding patterns) formed on a surface on which the heat generating bodies 361*a* to 361*c* are formed.

Therefore, even if the heat generating region of the heating member 361 is divided into a plurality of heat generating regions and the heat generating regions are independently controlled, it is also possible to reduce a heater width in the conveying direction of a medium (e.g., to 10 mm or less) and mount the heating member 361 on the fixing apparatus 36 of a small type having a belt diameter of 20 to 30 mm.

Note that, in this embodiment, the heat generation in the portion equivalent to the image size is explained. However, it is also possible to segment the heater and heat only a place where an image is present or heat a place where a temperature difference is partially present because of some reasons while correcting the temperature difference.

Second Embodiment

Figure 10:
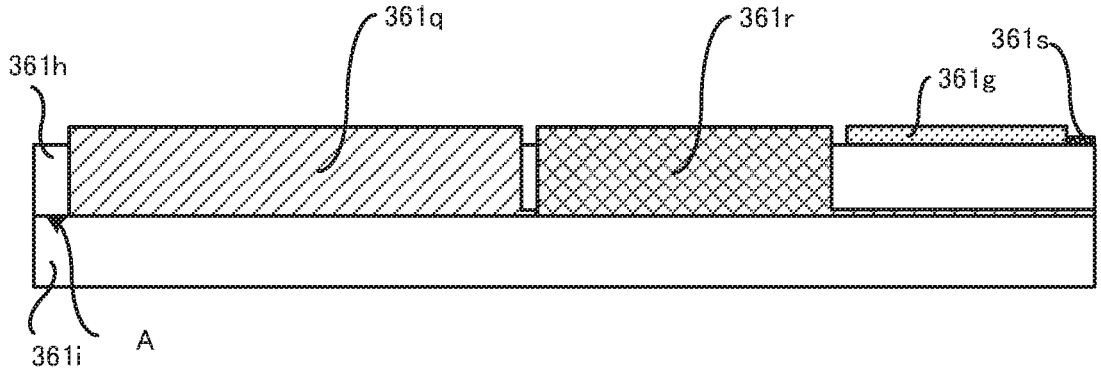
FIG. 10 is a side view showing a power feeding structure to a heat generating section in a second embodiment.
Figure 11:
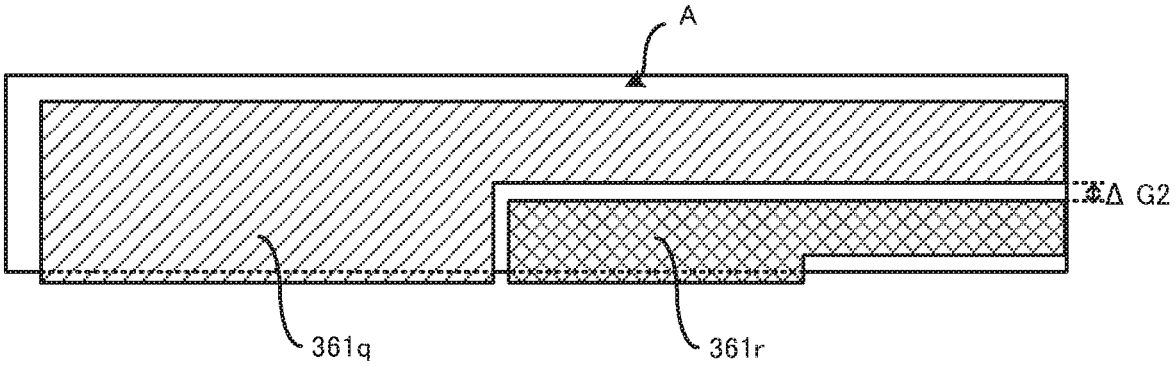
FIG. 11 is a sectional view on a boundary surface A shown in FIG. 10.

FIG. 10 is a side view showing a power feeding structure to a heat generating section group in a second embodiment. FIG. 11 is a sectional view on the boundary surface A shown in FIG. 10. Note that reference numerals and signs common to the reference numerals and signs in the first embodiment indicate the same components. It is assumed that a heat generating section group is divided into three as in the first embodiment.

As shown in FIG. 10, in this embodiment, an insulator substrate is changed from a three-layer structure to a two-layer structure. The number of layers is reduced to the number of layers smaller than the number of heat generating section groups. As shown in FIG. 11, in order to reduce the number of layers of the insulating substrate, in the boundary surface A, the electric conductor 361*q* and the electric conductor 361*r* are formed to be separated by a predetermined width ΔG2.

Note that, in this embodiment, the electric conductors 361*q* and 361*r* are provided on the side surface of the insulator substrate. However, it is also possible to cause the electric conductors to conduct to a power feeding path from the electrode portions through through-holes formed inside the insulators without using the side surface.

As explained above, according to this embodiment, two of the three electric conductors 361*q* to 361*s* share the same boundary surface to configure the power feeding path. Therefore, it is possible to reduce the number of stacked layers of the insulator substrate compared with the first embodiment and reduce the thickness of the entire heating member 361. The same applies when the number of divisions of the heat generating section group is further increased. This is effective because, if the number of layers of the insulator substrate has to be increased according to an increase in the number of divisions, a power feeding path of a plurality of electric conductors can be constructed with respect to one boundary surface. Since the number of stacked layers of the insulator substrate decreases, there is also an advantage that manufacturing cost can be reduced.

Third Embodiment

Figure 12:
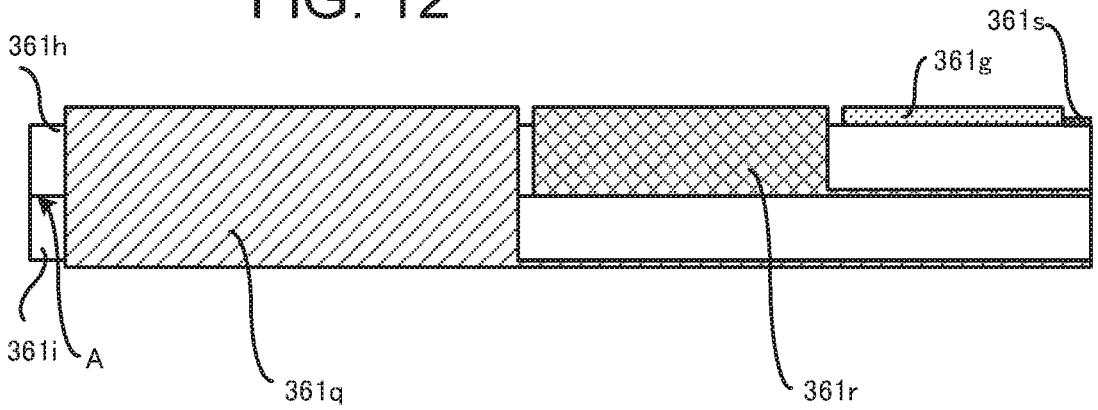
FIG. 12 is a side view showing a power feeding structure to a heat generating section in a third embodiment.

FIG. 12 is a side view showing a power feeding structure to a heat generating section group in a third embodiment. As shown in FIG. 12, this embodiment is different from the two embodiments explained above in that the electric conductor 361*q* is formed not only on the boundary surface between the substrates but also on the bottom surface of the insulator substrate 361*i* of the bottom layer rather. Since a power feeding path is formed on the bottom surface of the insulator substrate 361*i*, a temperature detecting unit of a contact type cannot be disposed on the bottom surface. Therefore, it is suitable to perform temperature control using a non-contact temperature detecting unit instead.

Note that, in this embodiment, the electric conductors 361*q* and 361*r* are provided on a side surface of the insulator substrate. However, it is also possible to cause the electric conductors to conduct to the power feeding path from electrode portions through through-holes formed inside the insulators without using the side surface (see a through-hole 361*th* shown in FIG. 16 for explaining a fifth embodiment below).

According to this embodiment, it is possible to reduce the number of stacked layers of the insulator substrate compared with the first embodiment and reduce the thickness of the entire heating member 361. Since the number of stacked layers of the insulator substrate decreases, there is also an advantage that manufacturing cost can be reduced.

Fourth Embodiment

Figure 13:
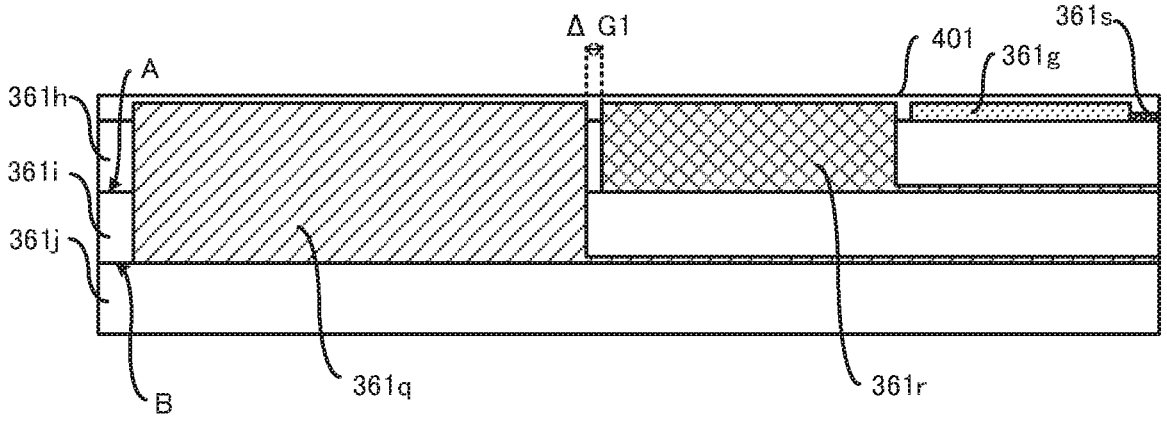
FIG. 13 is a side view showing a power feeding structure to a heat generating section in a fourth embodiment.
Figure 14:
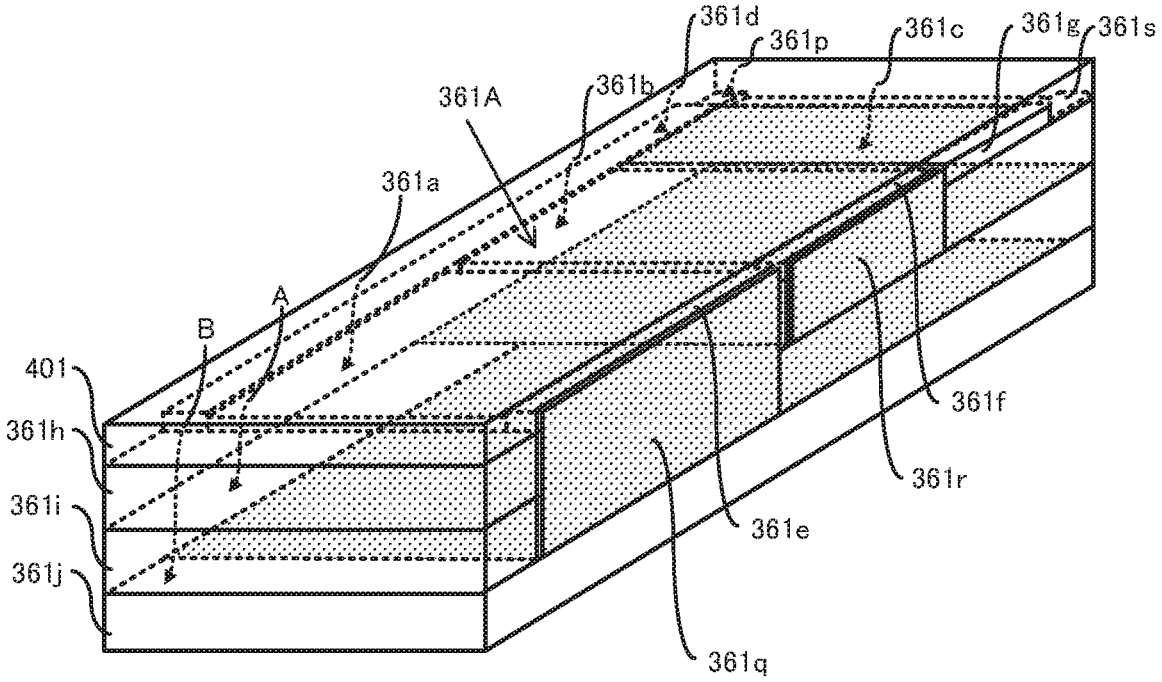
FIG. 14 is a transparent perspective view showing the power feeding structure shown in FIG. 13.

FIG. 13 is a side view showing a power feeding structure to a heat generating section group in a fourth embodiment. FIG. 14 is a transparent perspective view showing the power feeding structure shown in FIG. 13. As shown in the figures, in this embodiment, a heater further includes an insulator substrate 401 that is stacked on the upper surface side of the top layer (the insulator substrate 361*h*) of the plurality of insulator substrates 361*h* to 361*j* and covers the surfaces of the plurality of heat generating bodies 361*a* to 361*c* and the upper surfaces of the electrodes 361*e* to 361*g*.

The insulator substrate 401 may be formed of a material same as the material of the insulator substrates 361*h* to 361*j* but may be formed of another material having heat resistance and insulation.

In this way, according to this embodiment, since the insulator substrate 401 having heat resistance is further stacked to cover the surfaces of the plurality of heat generating bodies 361*a* to 361*c*, insulation among the plurality of heat generating bodies 361*a* to 361*c* is secured. It is possible to prevent occurrence of temperature unevenness.

Fifth Embodiment

Figure 15:
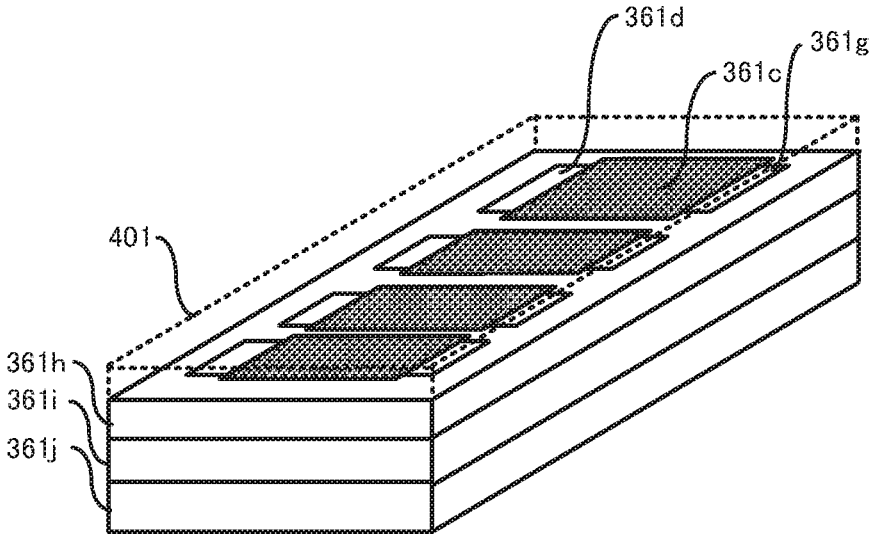
FIG. 15 is a perspective view showing a power feeding structure to a heat generating section in a fifth embodiment.
Figure 16:
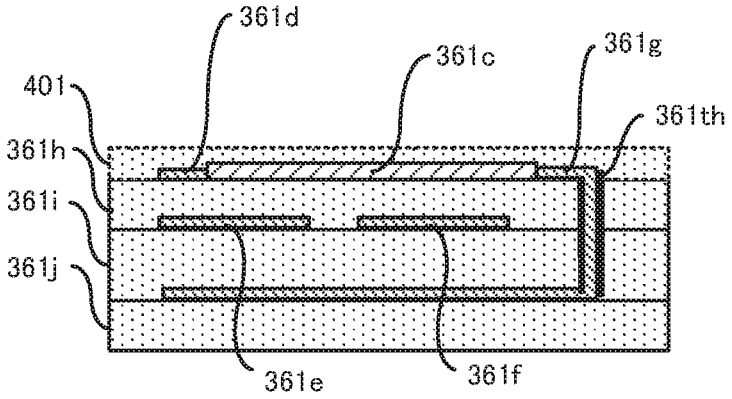
FIG. 16 is a sectional view showing the power feeding structure shown in FIG. 15.

FIG. 15 is a perspective view showing a power feeding structure to a heat generating section group in a fifth embodiment. FIG. 16 is a sectional view showing the power feeding structure shown in FIG. 15. As shown in the figures, the common electrode 361*d* on one end side of the plurality of heat generating bodies 361*a* to 361*c* is formed on a heat generating surface side. The electrode 361*g* on the other end side is formed to pass from the heat generating surface side to the rear surface side via the through-hole 361*th* formed in the thickness direction of the insulator substrate 361*h*.

In this way, according to this embodiment, since the electrodes are respectively formed on the front surface side and the rear surface side of the heat generating section, it is possible to form the electrodes to correspond to the positions of power feeding sockets (not shown in the figures) without increasing the size of the heating member 361.

Sixth Embodiment

In the configuration example of the fixing apparatus shown in FIG. 4, the heat generating section side of the heating member 361 is provided in contact with the inner side of the endless belt 363 and is pressed in the direction of the press roller 366 opposed to the endless belt 363. Consequently, the toner is heated and fixed on the sheet P that moves while being held between the endless belt 363 and the press roller 366. The driving of the endless belt 363 at this point is performed by the belt conveying roller 364 to which the driving motor is connected.

However, it is also possible to drive the press roller 366 to convey the sheet P.

Figure 17:
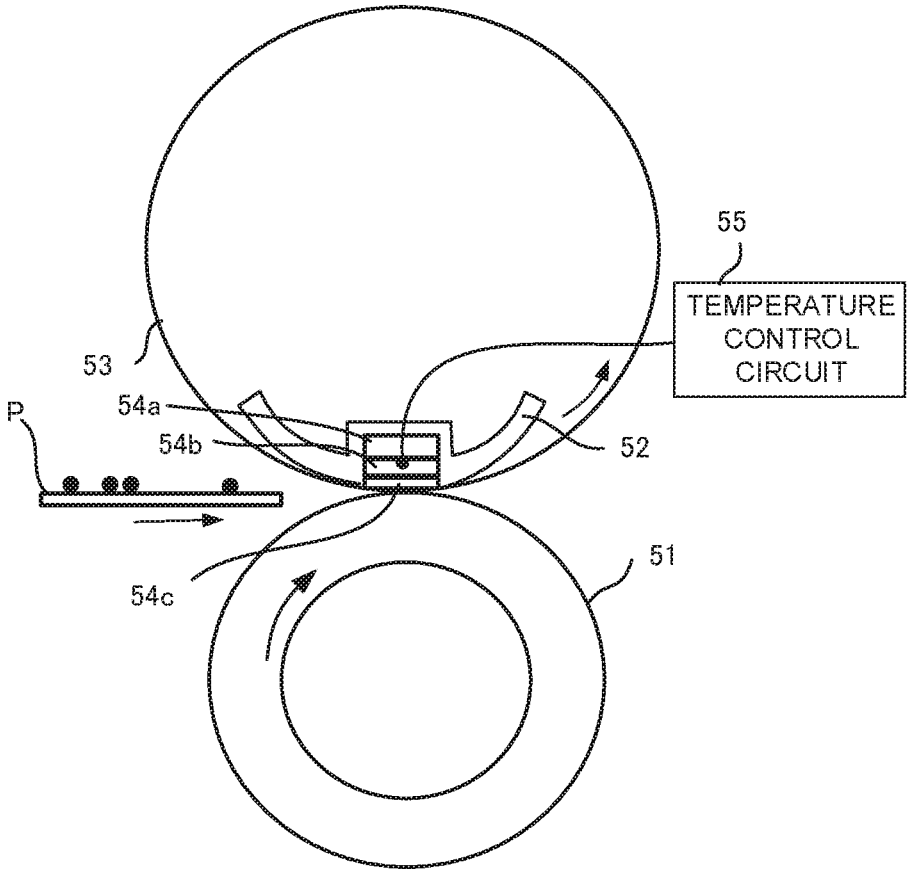
FIG. 17 is a diagram showing a configuration example of a fixing apparatus according to a sixth embodiment.

A configuration example of such a fixing apparatus is shown in FIG. 17. In the fixing apparatus shown in FIG. 17, a press roller is driven. A film guide 52 having an arcuate shape in section is provided to be opposed to a press roller 51. A fixing film 53 is rotatably attached to the outer side of the film guide 52. A ceramic heater 54*a*, a plurality of heat generating sections 54*b*, and a surface protecting layer 54*c* are stacked and provided on the inner side of the film guide 52. This stacked section is in pressed contact with the press roller via the fixing film 53 to form a nip section.

As explained above, the heating sections are connected in parallel and connected to a temperature control circuit 55. The temperature control circuit 55 controls a not-shown switching element to open and close and controls temperature.

During the operation of the fixing apparatus, the press roller 51 connected to a driving motor is driven to rotate to cause the fixing film in contact with the press roller 51 to rotate following the press roller 51. At this point, the sheet P entering between the fixing film 53 and the press roller 51 from the left is heated to fix a toner image on the sheet P and is discharged to the right.

In this way, the fixing apparatus according to the embodiment can also be formed in the structure for applying a driving force from the press roller side.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A heater comprising:

a first insulator substrate and a second insulator substrate, wherein a bottom surface of the first insulator substrate is disposed on a top surface of the second insulator substrate;

a heat generating section in which a plurality of divided regions are formed in a longitudinal direction on a top surface of the first insulator substrate, each of the plurality of divided regions being independently controllable to generate heat;

a common electrode connected to the plurality of divided regions;

a plurality of individual electrodes respectively connected to the plurality of divided regions; and a plurality of electric conductors respectively connected to the plurality of individual electrodes, wherein one of the electric conductors extends longitudinally from one of the individual electrodes along the top surface of the first insulator substrate, and another one of the electric conductors has a first portion that is connected to another one of the individual electrodes and is formed over a side surface of the first insulator substrate and a second portion that extends longitudinally from the first portion along the top surface of the second insulator substrate.

2. The heater according to claim 1, further comprising:

a third insulator substrate, wherein a bottom surface of the second insulator substrate is disposed on a top surface of the third insulator substrate, wherein the plurality of electric conductors includes an electric conductor that is formed over the side surface of the first insulator substrate and a side surface of the second insulator substrate, and extends longitudinally along the top surface of the third insulator substrate.

3. The heater according to claim 1, wherein the plurality of electric conductors include two independent electric conductors, one of which is the second portion of said another one of the electric conductors, that extend longitudinally along the top surface of the second insulator substrate.

4. The heater according to claim 1, wherein the plurality of electric conductors are integrated on one side in the longitudinal direction of the first insulator substrate.

5. The heater according to claim 4, further comprising a plurality of switches respectively connected to the plurality of electric conductors.

6. The heater according to claim 1, wherein the plurality of electric conductors are formed to be separated from each other by a predetermined distance.

7. A heater comprising:

a first insulator substrate and a second insulator substrate, wherein a bottom surface of the first insulator substrate is disposed on a top surface of the second insulator substrate;

a heat generating section in which a plurality of divided regions are formed in a longitudinal direction on a top surface of the first insulator substrate, each of the plurality of divided regions being independently controllable to generate heat;

a third insulator substrate, wherein a bottom surface of the second insulator substrate is disposed on a top surface of the third insulator substrate;

a common electrode connected to the plurality of divided regions;

a plurality of individual electrodes respectively connected to the plurality of divided regions; and a plurality of electric conductors respectively connected to the plurality of individual electrodes, wherein one of the electric conductors extends longitudinally from one of the individual electrodes along the top surface of the first insulator substrate, and another one of the electric conductors has a first portion that is connected to another one of the individual electrodes and is formed over a side surface of the first insulator substrate and a second portion that extends longitudinally from the first portion along the top surface of the second insulator substrate.

8. The heater according to claim 7, wherein the plurality of electric conductors include three independent electric conductors, one of which is the second portion of said another one of the electric conductors, that extend longitudinally along the top surface of the second insulator substrate.

9. The heater according to claim 7, wherein the plurality of electric conductors are integrated on one side in the longitudinal direction of the first insulator substrate.

10. The heater according to claim 9, further comprising a plurality of switches respectively connected to the plurality of electric conductors.

11. A fixing apparatus comprising:

an endless rotating body;

a heater including a first insulator substrate and a second insulator substrate, wherein a bottom surface of the first insulator substrate is disposed on a top surface of the second insulator substrate, a heat generating section in which a plurality of divided regions are formed in a longitudinal direction on a top surface of the first insulator substrate, each of the plurality of divided regions being independently controllable to generate heat, a common electrode connected to the plurality of divided regions, a plurality of individual electrodes respectively connected to the plurality of divided regions, and a plurality of electric conductors respectively connected to the plurality of individual electrodes, wherein one of the electric conductors extends longitudinally from one of the individual electrodes along the top surface of the first insulator substrate, another one of the electric conductors has a first portion that is connected to another one of the individual electrodes and is formed over a side surface of the first insulator substrate and a second portion that extends longitudinally from the first portion along the top surface of the second insulator substrate, and the heater is provided on an inner side of the endless rotating body; and a pressurizing body opposed to the heater across the endless rotating body and configured to form a nip for pressing a recording medium in conjunction with the endless rotating body.

12. The fixing apparatus according to claim 11, wherein the plurality of electric conductors are integrated on one side in the longitudinal direction of the first insulator substrate.

13. The fixing apparatus according to claim 11, further comprising a plurality of switches respectively connected to the plurality of electric conductors.

14. The fixing apparatus according to claim 11, wherein the plurality of electric conductors are formed to be separated from each other by a predetermined distance.

* * * * *